US006746100B2

(12) United States Patent
Imai et al.

(10) Patent No.: US 6,746,100 B2
(45) Date of Patent: Jun. 8, 2004

(54) INK JET RECORDING APPARATUS AND MAINTENANCE METHOD

(75) Inventors: Koji Imai, Inuyama (JP); Hirotake Nakamura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/902,742

(22) Filed: Jul. 12, 2001

(65) Prior Publication Data

US 2002/0005874 A1 Jan. 17, 2002

(30) Foreign Application Priority Data

Jul. 13, 2000 (JP) ..... 2000-213430
Jul. 25, 2000 (JP) ..... 2000-224366

(51) Int. Cl.[7] ..... B41J 2/165
(52) U.S. Cl. ..... 347/35
(58) Field of Search ..... 347/10, 11, 23, 347/24, 33, 35, 60

(56) References Cited

U.S. PATENT DOCUMENTS 4,513,299 A * 4/1985 Lee et al. ..... 347/15
5,455,608 A * 10/1995 Stewart et al. ..... 347/23
5,493,319 A * 2/1996 Hirabayashi et al. ..... 347/29
5,517,217 A * 5/1996 Haselby et al. ..... 347/23
5,541,628 A * 7/1996 Chang et al. ..... 347/10
6,033,050 A * 3/2000 Morita et al. ..... 347/23
6,126,260 A * 10/2000 Lan et al. ..... 347/11
6,325,492 B1 * 12/2001 Koitabashi et al. ..... 347/57
6,386,677 B1 * 5/2002 Imai et al. ..... 347/23

FOREIGN PATENT DOCUMENTS

JP 11078068 A * 3/1999 ..... B41J/2/165

* cited by examiner

*Primary Examiner*—Stephen D. Meier
*Assistant Examiner*—Blaise Mouttet
(74) *Attorney, Agent, or Firm*—Oliff & Berridge, PLC

(57) ABSTRACT

An ink jet recording apparatus in which after each purging operation, a wiping operation is performed, and then a preliminary ejection is performed. In the preliminary ejection operation, a preliminary ejection by a small dot waveform is performed, and then a preliminary ejection by a larger dot waveform than the small dot waveform is performed.

30 Claims, 8 Drawing Sheets

INK JET RECORDING APPARATUS AND MAINTENANCE METHOD

BACKGROUND OF THE INVENTION

1. Field of Invention

The invention relates to an ink jet recording apparatus, particularly to an ink jet recording apparatus and its maintenance method capable of keeping a recording head in a proper state.

2. Description of Related Art

Conventionally, an ink jet printer, for example, is known as a recording apparatus that produces records of prints by ejecting ink onto a recording medium such as paper. In the ink jet printer, there is provided an ink cartridge where ink is stored, which is replaceable from a recording head unit including a recording head. The ink is supplied from the ink cartridge into the recording head, where the ink is ejected from each nozzle to produce records.

When the user presses a predetermined switch while the ink jet printer is in operation, a maintenance operation is manually performed to keep the head in a proper state. When a predetermined condition is satisfied or the ink cartridge is replaced with a new one, the maintenance operation is automatically performed. For example, a so-called purging operation is performed. The purging operation is performed in the following manners: one is that the ink is sucked in at the end of the nozzle, that is a nozzle surface where the nozzle is open, and the other one is that the ink in the recording head is forcedly ejected through the application of pressure to an ink supply part.

The purging operation described below is an operation for removing the ink from the recording head through the use of suction via a suction cap by putting the suction cap on the nozzle surface and creating a negative pressure within the suction cap by a suction pump.

The ink jet printer, where the purging operation is performed, is capable of eliminating air bubbles or minute contaminants occurring during the purging operation from ejection channels, to thereby return the ink ejection from the nozzles to the normal state and recover the recording quality.

However, in some cases, air bubbles and minute contaminants occurring within the nozzles are not able to be fully eliminated only with the purging operation by suction through the use of negative pressure as described above. Minute bubbles and contaminants are apt to be adhered to the interior walls of the channels (not shown) and manifolds forming the ink passages, resulting in a lower velocity of ink near the interior walls. Therefore, it is difficult to eliminate bubbles and contaminants adhered to the interior walls even if the purging operation is performed. Such minute bubbles and contaminants have little effect on ink ejection when dots of small diameter are printed in a stable cycle. However, when the ink is continuously ejected at high frequencies, bubbles adhered to the walls suddenly expand or move around, resulting in an interruption of the ink ejection. In the ink jet printer, it is necessary to eject the ink in an appropriate cycle in accordance with the change of dot patterns to be printed. As a result, the recording quality is lowered because of the minute bubbles and contaminants, which are difficult to eliminate with the purging operation.

Therefore, there are some ink jet printers that eliminate the minute bubbles and contaminants as much as possible by repeating the purging operation. However, it is still hard to completely eliminate the bubbles and contaminants. In addition, the repetition of the purging operation increases the number of disposed ink cartridges that are not used for printing, which results in raised running costs and additional time till the maintenance operation is completed.

In the ink jet printer where the purging operation is performed, the ink ejected during the purging operation is adhered to the nozzle surface. When left standing, the adhered ink may have a detrimental effect on the recording head such as ink ejection failure and ink clogging. It is preferable that such ink is eliminated immediately. Therefore, after the purging operation, to wipe the adhered ink from the nozzle surface of the recording head, a wiper operation is performed by bringing a wiper into contact with the nozzle surface of the recording head and moving the recording head.

However, the ink adhered to the nozzle surface immediately after the purging operation includes a lot of minute air bubbles generated due to hard ink flow by the purging operation. Furthermore, because the ink inside the recording head is acted upon by a negative pressure (back pressure), which works in a direction to be drawn due to a porous structure of the ink cartridge as already known, some ink, including air bubbles, adhered to the nozzle surface is drawn back from each nozzle into the inside of the recording head. Therefore, the wiping operation that wipes the nozzle surface is not enough to eliminate the air bubbles, which have been drawn back into the recording head along with the ink. On the contrary, the wiping operation sometimes causes the ink, including bubbles, to get pushed back into the nozzle. In addition, when groups of nozzles for inks of various colors are provided on the nozzle surface, the wiping operation may cause different color ink to get pushed into the different nozzles.

To expel the bubbles or the different color ink from the recording head, a preliminary ejection or flushing operation can be used. In addition, bubbles or different color ink can also be ejected through the use of a high-frequency preliminary ejection.

However, when the ink is continuously ejected at high frequencies, the flow of ink is changed greatly and the meniscus in each nozzle may be destroyed, thus impeding a shift to the recording operation (so-called nozzle malfunction). On the other hand, when the ejection is performed at low frequencies, more time is needed to eliminate bubbles or different color ink, or the amount of ink to be ejected is eventually increased.

SUMMARY OF THE INVENTION

Therefore, the invention provides an ink jet recording apparatus and its maintenance method capable of restoring a recording head to a proper state and performing a maintenance method to shift to a recording operation immediately.

In an exemplary aspect of the invention, an ink jet recording apparatus comprises a head unit having a recording head that performs recording by ejecting ink onto a recording medium, a wiper mechanism that wipes the ink adhered to a nozzle surface of the recording head, and a preliminary ejection device that applies a drive voltage waveform for preliminary ejection to the recording head. In various embodiments, the preliminary ejection device comprises a first preliminary ejection drive device that generates a stable waveform which causes small fluctuations of ink pressure in the recording head, and applies the stable waveform to the recording head to cause a first preliminary ejection, a second preliminary ejection drive device that generates an unstable waveform which causes larger fluctuations of ink pressure in the recording head than the first preliminary ejection, and applies the unstable waveform to the recording head to cause a second preliminary ejection, and a control device that actuates the first preliminary ejection drive device after a wiping operation by the wiper mechanism so that the recording head performs the first preliminary ejection, and then actuates the second preliminary ejection drive device so that the recording head performs the second preliminary ejection.

In another exemplary aspect of the invention, an ink jet recording apparatus comprises a head unit having a recording head that performs recording by ejecting ink onto a recording medium, a wiper mechanism that wipes the ink adhered to a nozzle surface of the recording head, and a preliminary ejection device that applies a drive voltage waveform for a preliminary ejection to the recording head. In various embodiments, the preliminary ejection device comprises a first preliminary ejection drive device that generates a first drive voltage waveform, which causes a small amount of ink to be ejected, and applies the first drive voltage waveform to the recording head to perform a first preliminary ejection by small droplets, a second preliminary ejection drive device that generates a second drive voltage waveform, which causes a larger amount of ink to be ejected than the amount of ink at the first preliminary ejection by the small droplets, and applies the second drive voltage waveform to the recording head to perform a second preliminary ejection by larger droplets than the first preliminary ejection, and a control device that actuates the first preliminary ejection drive device after a wiping operation by the wiper mechanism so that the recording head performs the first preliminary ejection, and then actuates said second preliminary ejection drive device so that the recording head performs the second preliminary ejection.

In a further exemplary aspect of the invention, an ink jet recording apparatus comprises a head unit having a recording head that performs recording by ejecting ink onto a recording medium, a purge mechanism that forces the recording head to purge the ink therefrom by sucking the ink from an ink ejection side of the recording head or by applying a pressure to an ink supply side of the recording head, to improve an ink ejection condition, and a preliminary ejection device that generates a drive voltage waveform including at least an unstable waveform which causes fluctuations of ink pressure in the recording head, and applies the drive voltage waveform for a preliminary ejection to the recording head, the preliminary ejection device also comprising a control device that causes the recording head, that undergoes a purging operation, to perform the preliminary ejection before the purging operation by the purge mechanism.

In another exemplary aspect of the invention, a maintenance method for returning the ink ejection to an proper status in an ink jet recording apparatus, comprises the steps of wiping ink adhered to a nozzle surface by a wiper mechanism, performing a first preliminary ejection through the generation of a stable waveform as a drive voltage waveform which causes small fluctuations of ink pressure after the wiping step and the application of the stable waveform, and performing a second preliminary ejection through the generation of an unstable waveform as a drive voltage waveform, which causes larger fluctuations of ink pressure than the first preliminary ejection, and the application of the unstable waveform.

In a further exemplary aspect of the invention, a maintenance method for returning the ink ejection to an proper status in an ink jet recording apparatus, comprises the steps of wiping the ink adhered to a nozzle surface by a wiper mechanism, performing a first preliminary ejection by small droplets through the generation of a first drive voltage waveform which causes a small amount of ink to be ejected after the step of wiping by the wiper mechanism and the application of the first drive voltage waveform, and performing a second preliminary ejection by larger droplets than the first preliminary ejection through the generation of a second drive voltage waveform which causes a larger amount of ink to be ejected than the amount of ink at the first preliminary ejection by the small droplets and the application of the second drive voltage waveform.

In another exemplary aspect of the invention, a maintenance method for returning the ink ejection to an proper status in an ink jet recording, comprises the steps of performing a preliminary ejection through the generation of an unstable waveform as a drive voltage waveform which causes fluctuations of pressure in the recording head and the application of the unstable waveform to the recording head, and purging the recording head of the head unit after the step of performing the preliminary ejection.

BRIEF DESCRIPTION OF THE DRAWINGS

The invention will be described in greater detail with reference to preferred embodiments thereof and the accompanying drawings wherein.

DETAILED DESCRIPTION OF PREFERRED EMBODIMENTS

Figure 1:
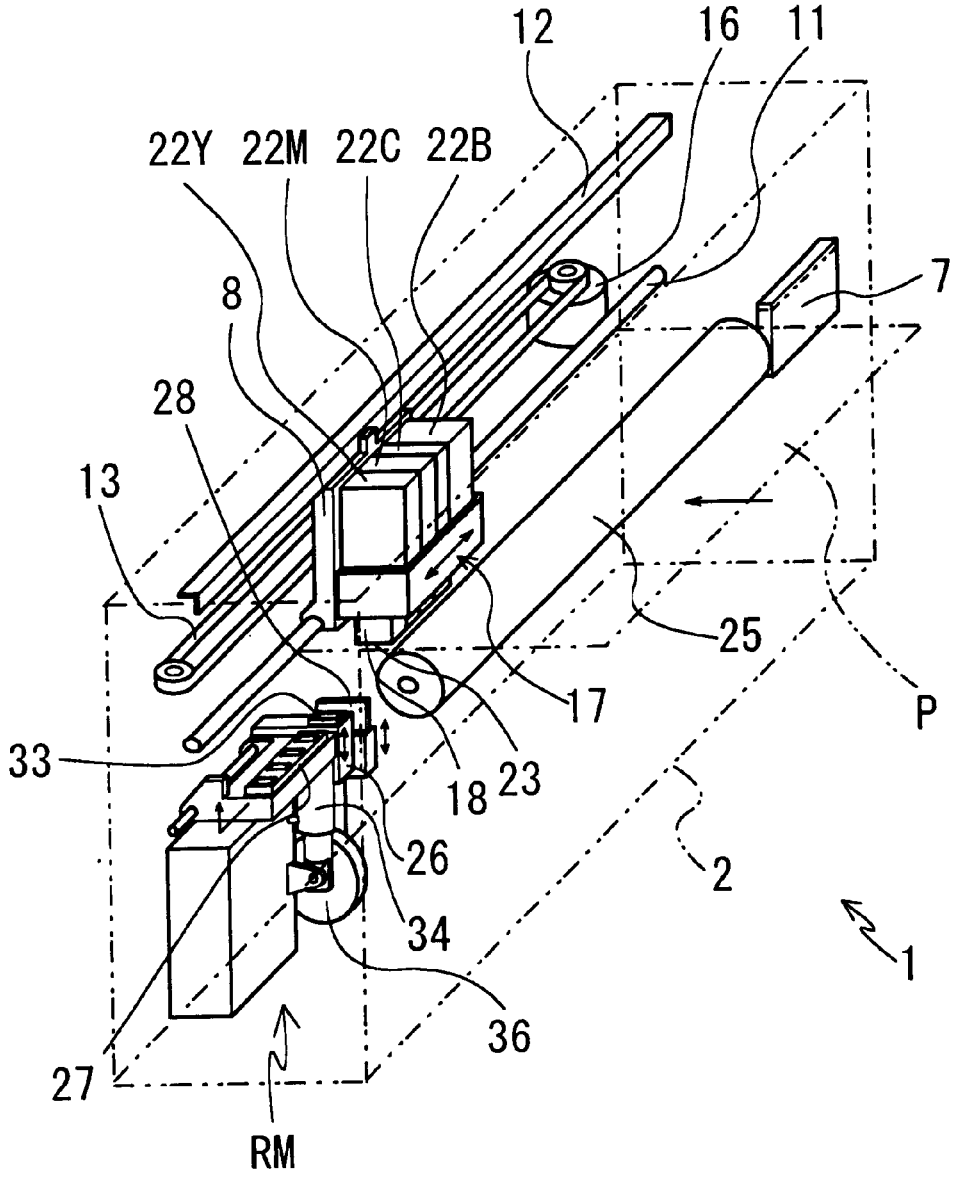
FIG. 1 is a perspective view illustrating an internal structure of an ink jet printer in an embodiment of the invention.
Figure 2:
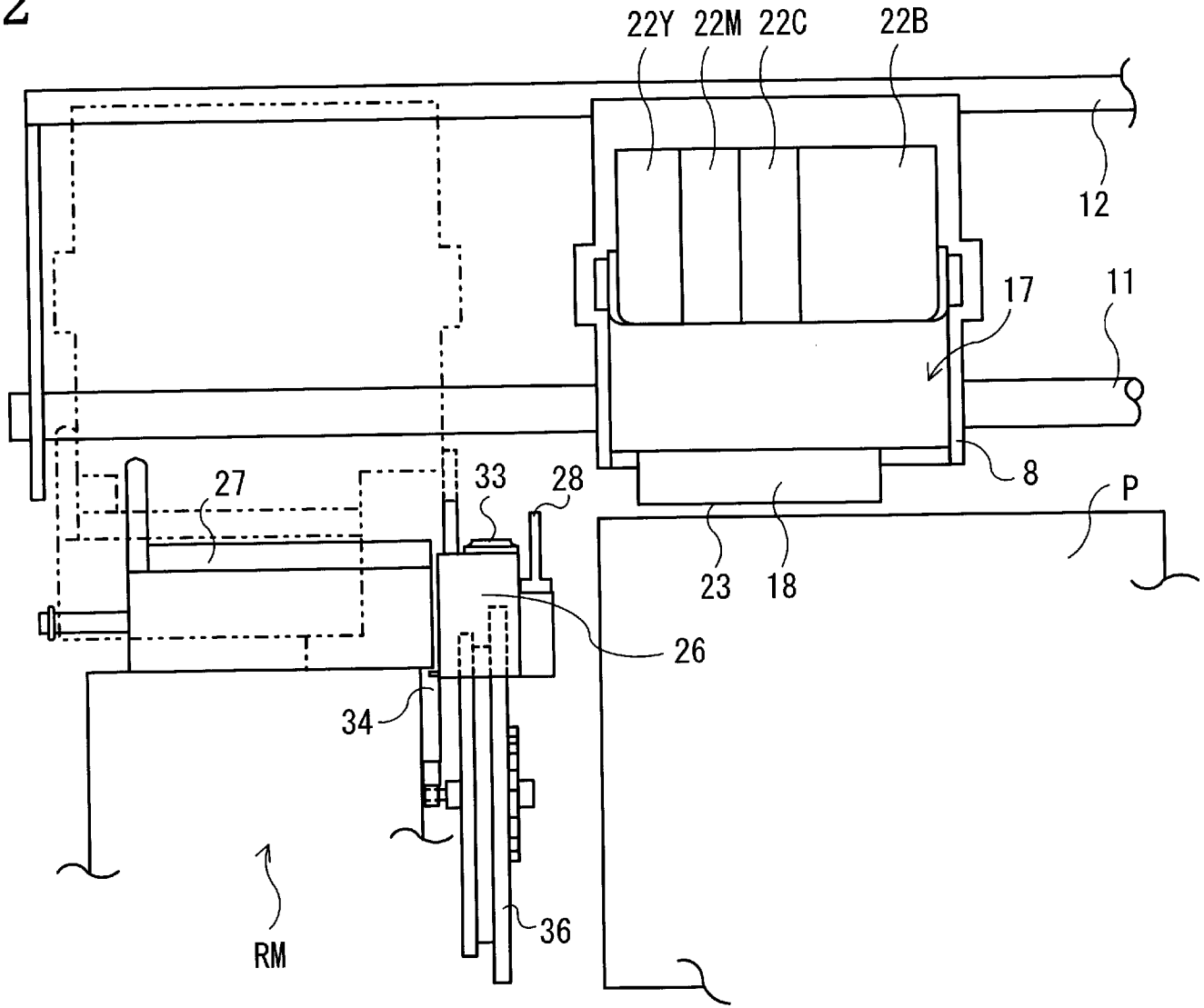
FIG. 2 is an enlarged view of a recovery mechanism RM.

An embodiment of the invention will be described in detail with reference to the accompanying drawings. An internal structure of an ink jet printer 1, which is an example of one embodiment of the recording apparatus of the invention, will be described with reference to FIGS. 1 and 2. FIG. 1 is a perspective view showing the internal structure of the ink jet printer 1. FIG. 2 is an enlarged view of the recovery mechanism RM.

As shown in FIG. 1, a carriage 8 is provided in a body 2 of the ink jet printer 1. The carriage 8 is slidably supported by a guide rod 11 and a guide member 12, secured to a belt 13, and driven by a CR motor 16 for reciprocating motion. Attached to the carriage 8 is a recording head unit 17 including a recording head 18 for printing. The recording head 18 is of the ink jet type where printing is performed by jetting ink drops of four colors (cyan, magenta, yellow, and black) onto a paper P of a recording medium, and includes four groups of nozzles for cyan, magenta, yellow, and black colors.

Detachably mounted on the recording head unit 17 are four ink cartridges 22Y, 22M, 22C, 22B, which are intended for supplying the ink of each color to corresponding nozzles. In the recording head 18, a plurality of linear recesses, parallel to each other, are cut at piezoelectric materials into a plurality of ink channels (e.g. 64 channels, not shown), in which the ink is passed. These channels are opened at the nozzle surface 23, forming a plurality of ink jet nozzles.

Therefore, a voltage at a predetermined frequency is applied to a piezoelectric material placed on a wall surface of each channel, which serves as an actuator, thereby enabling the ink to be ejected from a determined nozzle.

In the ink jet printer 1 of this embodiment, as shown in FIG. 1, a platen roller 25 that feeds the paper P is provided opposite to the recording head 18. The platen roller 25 is rotated by an LF motor 24 (FIG. 3), and the paper P is fed in the direction of the arrow shown in FIG. 1.

As shown in FIGS. 1 and 2, provided on a lower left part of the body 2 in FIG. 1, the recovery mechanism RM maintains and recovers the ink jet operation of the recording head 18. The recovery mechanism RM is provided with a suction device 26 that resolves ink jet problems, which occurs because the ink is dried out, bubbles are generated in the ink, or ink droplets are adhered to the nozzle surface 23 while the recording head 18 is in operation; a storage cap 27 that covers the nozzle surface 23 to prevent the ink from drying out when the ink jet printer 1 is not used; and a wiper 28 that wipes the nozzle surface 23. Further, as shown in FIG. 1, provided on a right end part in the body 2 is a flushing receiver 7 that receives the ink to be ejected from the recording head 18 in an after-mentioned preliminary ejection. The flushing receiver 7 is made of a highly hygroscopic material such as felt.

The suction device 26 is provided with a suction cap 33 that can come in contact with or separate from the nozzle surface 23 and a suction pump 34 that sucks ink via the suction cap 33 when it makes contact with the recording head 18. The suction device 26 which is driven by a cam 36 and a cam drive motor (not shown), moves the suction cap 33 and the wiper 28 back and forth toward the recording head 18 and drives the suction pump 34 to perform aspiration (the purging operation) via the suction cap 33.

Figure 3:
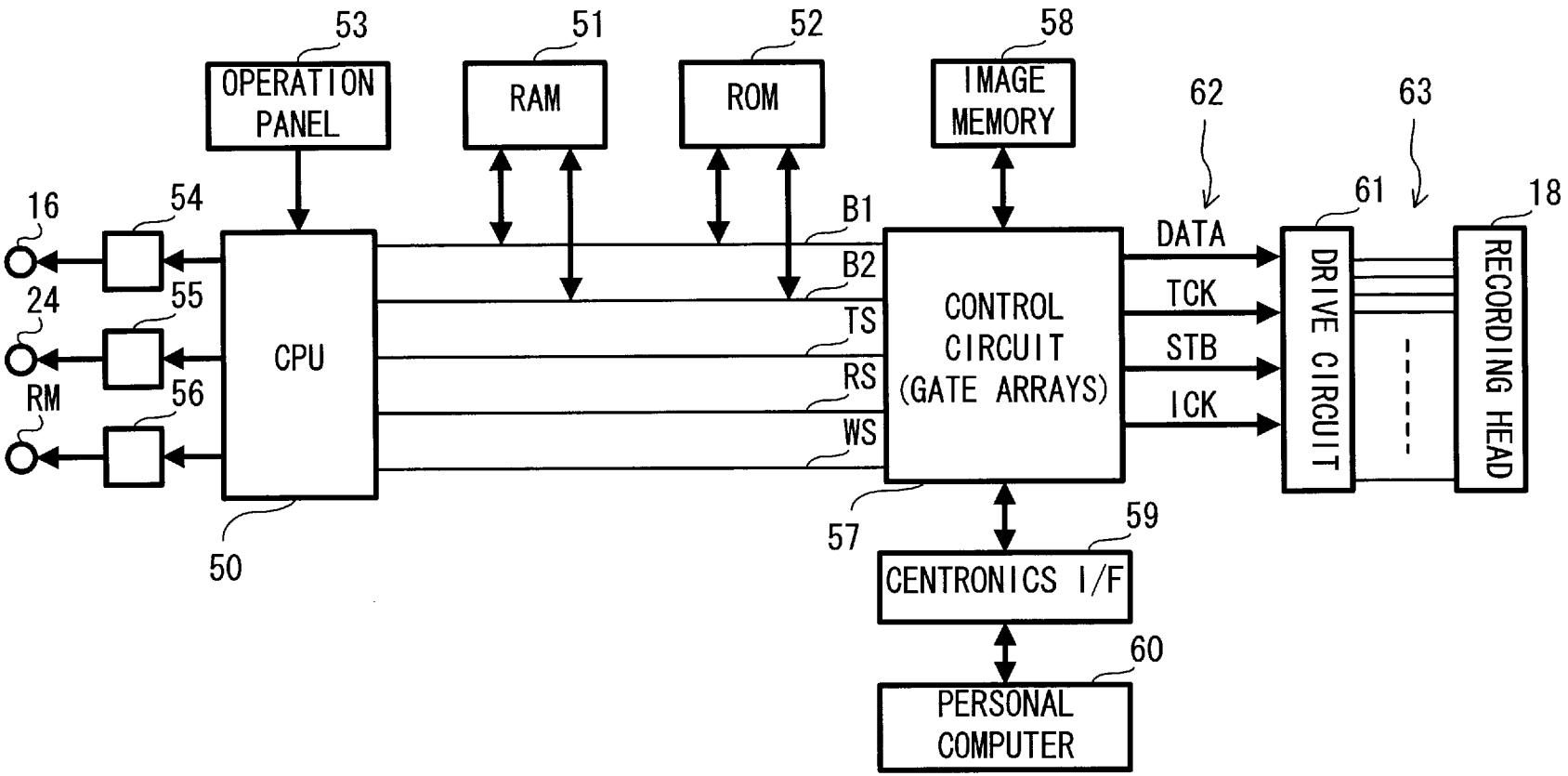
FIG. 3 is a block diagram illustrating an electrical structure of the ink jet printer.

An electrical configuration of the ink jet printer 1 will now be described with reference to FIG. 3.

The ink jet printer 1 is provided with a one-chip CPU 50 that controls the whole ink jet printer 1. A RAM 51 that temporarily stores data and a ROM 52 that stores various control programs are connected to the CPU 50 on a data bus B1 and an address bus B2. A control circuit 57, formed by gate arrays, is connected to the CPU 50 on the data bus B1 and the address bus B2. An image memory 58 that develops print data and a Centronics interface 59, intended for connection to a personal computer 60, are connected to the control circuit 57.

The CPU 50 generates, based on the programs stored in the ROM 52, a print timing signal TS and a control signal RS and transmits these signals to the control circuit 57. In accordance with the print timing signal TS and the control signal RS, the control circuit 57 generates, based on the image data stored in the image memory 58, print data DATA to be transmitted for forming the image data onto the paper P, a transmission clock TCK in sync with the transmission data DATA, a strobe signal STB, and a print clock ICK, and outputs these signals to a drive circuit 61. Additionally, the control circuit 57 generates a Centronics data interruption signal WS based on the Centronics data transmitted from external equipment like the personal computer 60 via the Centronics interface 59, and transmits the signal to the CPU 50.

The drive circuit 61 is connected to the control circuit 57 via a harness cable 62, and the print data DATA, the transmission clock TCK, the strobe signal STB, and the print clock ICK are input from the control circuit 57 to the drive circuit 61. The print data DATA, the transmission clock TCK, the strobe signal STB, and the print clock ICK are low voltage signals of approx. 5 V.

Further, the drive circuit 61 is connected to the recording head 18 via a harness cable 63. As the recording head 18 is made of shear-mode piezoelectric actuators, signals in the harness cable 63 are comparatively high-voltage signals of approx. 20 V. The harness cables 62, 63 are structured of flexible printed circuit boards.

An operation panel 53, where commands are input, is connected to the CPU 50. A CR motor 16 that drives the carriage 8 is connected to the CPU 50 via the CR motor drive circuit 54. An LF motor 24 that drives the platen roller 25 is connected to the CPU 50 via the LF motor drive circuit 55. A recovery mechanism drive circuit 56 is connected to the CPU 50, and structured to control the recovery mechanism RM.

Figure 4:
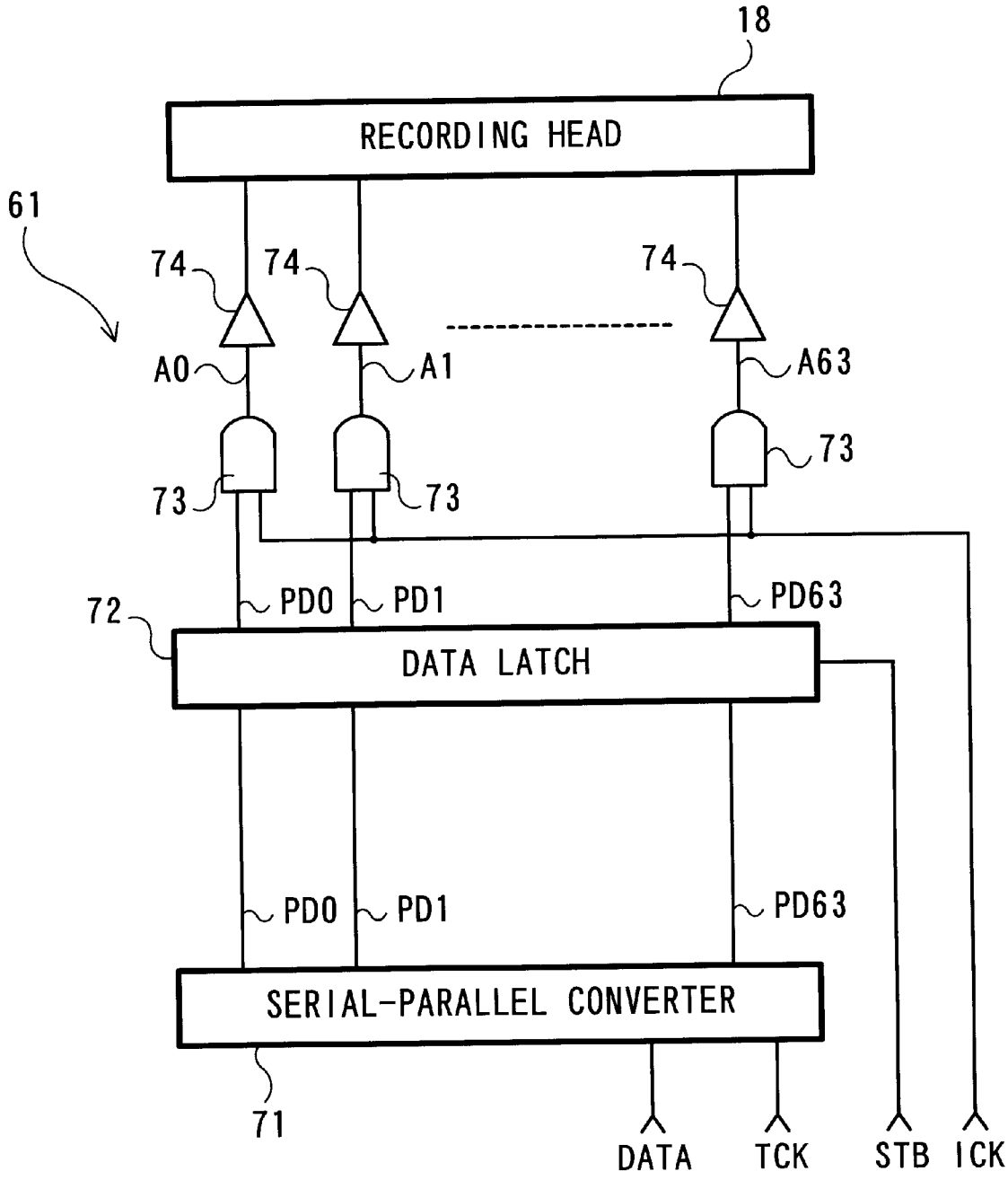
FIG. 4 illustrates an internal configuration of a drive circuit.

The internal configuration of the drive circuit 61 will now be described with reference to FIG. 4.

The drive circuit 61 is provided with a serial-parallel converter 71, a data latch 72, AND gates 73, and output circuits 74. The serial-parallel converter 71 is formed by a shift register for as many bits as the number of ink channels in the recording head 18. The serial-parallel converter 71 receives the print data DATA transmitted from the control circuit 57 in sync with the transmission clock TCK, and converts the print data to pieces of parallel data PD0–PD63. The data latch 72 latches each piece of parallel data PD0 to PD63 upon the rise of the strobe signal STB transmitted from the control circuit 57.

Each AND gate 73 performs a logical multiplication of each piece of parallel data PD0 to PD63 outputted from the data latch 72 and the print clock ICK transmitted from the control circuit 57, and generates drive data A0 to A63. Each output circuit 74 generates a 20 V pulse signal based on the drive data A0 to A63, and outputs the signal to a corresponding piezoelectric actuator provided in the recording head 18.

Figure 5:
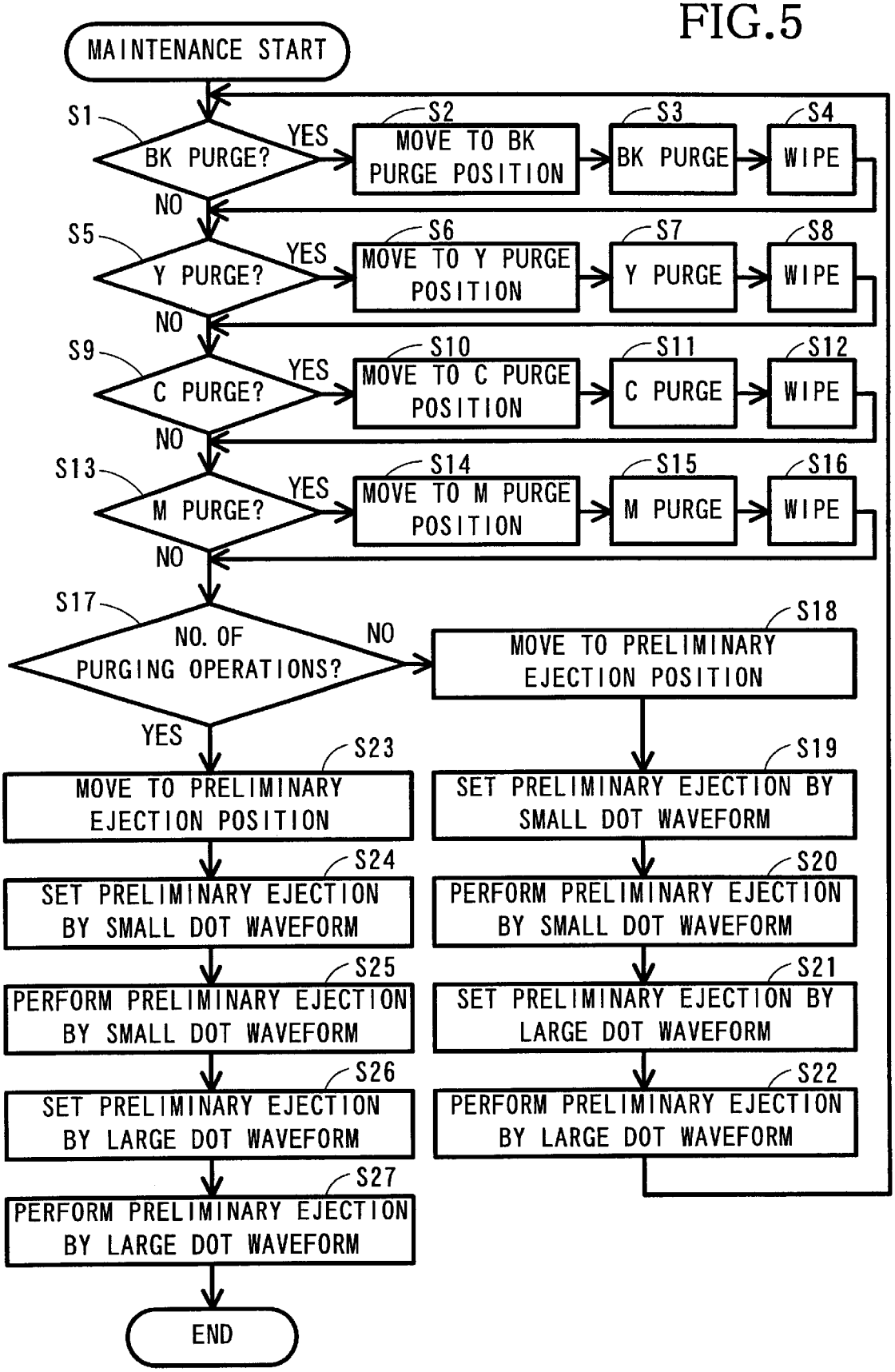
FIG. 5 is a flowchart illustrating a maintenance process of the ink jet printer.

The maintenance process of the ink jet printer 1 of this embodiment will now be described. FIG. 5 is a flowchart illustrating the maintenance process of the ink jet printer 1, and FIGS. 6A and 6B show drive waveforms for ink ejection used in the ink jet printer 1. The maintenance process program, shown in FIG. 5, is stored in the ROM 52, shown in FIG. 3, and performed by the CPU 50.

After any of the ink cartridges 22Y, 22M, 22C, 22B is replaced, a maintenance process (initial purge) to be performed at an initial introduction of ink is performed in the ink jet printer 1. When the operator finds defects in a print, such as a missed dot, the maintenance process is performed with the touch of a purge button (not shown) provided on the operation panel 53. Further, the maintenance process is automatically performed even when a specified time has elapsed after the previous maintenance process.

As shown in FIG. 5, when the maintenance process is started, based on the type of a replaced ink cartridge or operation by the purge button, the CPU 50 determines which color of ink a nozzle to which the purging operation is commanded (S1, S5, S9, S13) belongs to. When the nozzle to perform the purging operation belongs to black ink (S1: Yes), the carriage 8 is moved until the nozzle for the black ink in the recording head 18 faces the suction cap 33 (S2).

The suction cap 33 is caused to contact the nozzle for the black ink in the recording head 18. The suction pump 34 is driven to perform the purging operation (aspiration) via the suction cap 33 (S3). The carriage 8 is moved, the wiper 28 wipes the entire nozzle surface 23 of the recording head 18 (S4), and the CPU 50 goes to S5.

When the nozzle to undergo the purging operation is used for yellow ink (S5: Yes), the carriage 8 is moved until the nozzle for the yellow ink in the recording head 18 faces the suction cap 33 (S6).

The suction cap 33 is caused to contact the nozzle for the yellow ink in the recording head 18. The suction pump 34 is driven to perform the purging operation (aspiration) via the suction cap 33 (S7). The carriage 8 is moved, the wiper 28 wipes the entire nozzle surface 23 of the recording head 18 (S8), and the CPU 50 goes to S9.

When the nozzle to perform the purging operation belongs to cyan ink (S9: Yes), the carriage 8 is moved until the nozzle for the cyan ink in the recording head 18 faces the suction cap 33 (S10).

The suction cap 33 is caused to contact the nozzle for the cyan ink in the recording head 18. The suction pump 34 is driven to perform the purging operation (aspiration) via the suction cap 33 (S11). The carriage 8 is moved, the wiper 28 wipes the entire nozzle surface 23 of the recording head 18 (S12), and the CPU 50 goes to S13.

When the nozzle to perform the purging operation belongs to magenta ink (S13: Yes), the carriage 8 is moved until the nozzle for the magenta ink in the recording head 18 faces the suction cap 33 (S14).

The suction cap 33 is caused to contact the nozzle for the magenta ink in the recording head 18. The suction pump 34 is driven to perform the purging operation (aspiration) via the suction cap 33 (S15). The carriage 8 is moved, the wiper 28 wipes the entire nozzle surface 23 of the recording head 18 (S16), and the CPU 50 goes to S17.

When the purging operation is completed, the CPU 50 determines whether the purging operation is performed a set number of times (S17). For example, assume that the purging operation is performed twice. If the purging operation is finished only once (S17: No), the CPU 50 goes to S18. If the purging operation is finished twice (S17: Yes), the maintenance process is finished. The number of times for purging operation performed during a maintenance process is stored in the ROM 52 as a rated value. Normally, the purging operation is performed twice, however, it can be performed an arbitrary number of times such as three or four times.

When the CPU 50 determines No at S17, it goes to S18. At S18, the recording head 18 is moved to a preliminary ejection position. Concretely, in the body 2, the carriage 8 is moved to the right (in FIG. 1) until the recording head 18 faces the flushing receiver 7.

The CPU 50 executes a process at S19. At S19, a preliminary ejection with 500 ink droplets by a small dot waveform, which is a stable waveform, is set for all ink jet nozzles of the recording head 18. This setting is stored in RAM 51 shown in FIG. 3. Drive waveform data required to perform the preliminary ejection by the small dot waveform is stored in the ROM 52. An example of the small dot waveform will be described later.

When the process at S19 is completed, the preliminary ejection with 500 ink droplets by the small dot waveform is performed for all nozzles (S20). In this process, based on the data for ejecting 500 ink droplets by the small dot waveform stored in the RAM 51 at S19, the CPU 50 transmits the drive signal from the drive circuit 61 to the recording head 18 via the control circuit 57, and the ink droplets are ejected from all nozzles toward the flushing receiver 7 as shown in FIG. 7A.

This action moistens the nozzles (prevents the nozzles from being dried), and eliminates the different color ink pushed into the nozzles by wiping operation and/or the ink including bubbles, and the bubbles and contaminants adhered near the nozzle inside the channel. In addition, this action keeps the meniscus of ink in a nozzle in a stable condition, which will be achieved before ink ejection.

At S21, for the nozzles where the purging operation was performed at S1–S16 (hereinafter referred to as purged nozzle), a preliminary ejection with 10,000 ink droplets by a large dot waveform, which is an unstable waveform and requires a larger amount of ink as compared with the small dot waveform, is set (S21). This setting is stored in the RAM 51 shown in FIG. 3. Drive waveform data required to perform the preliminary ejection by the large dot waveform is stored in the ROM 52 shown in FIG. 3. An example of the large dot waveform will be described later.

When the process at S21 is completed, the preliminary ejection with 10,000 ink droplets by the large dot waveform is performed for the purged nozzle (S22). In this process, based on the data for ejecting 10,000 ink droplets by the large dot waveform stored in the RAM 51 at S21, the CPU 50 transmits the drive signal from the drive signal 61 to the recording head 18 via the control circuit 57, and the ink droplets are ejected from the nozzles toward the flushing receiver 7 as shown in FIG. 7B.

This action leads to the elimination of the bubbles or color-blended ink pushed deeply into the channel and separation of the bubbles on the interior wall surface of the channel. In a channel containing a relatively high proportion of trapped air bubbles, the preliminary ejection by the large dot waveform is used to intentionally destroy the meniscus of ink in a nozzle, triggering a so-called nozzle malfunction.

In this flowchart, the purged nozzle performs the preliminary ejection by the small dot waveform, and then the preliminary ejection by the large dot waveform. In other embodiments, the preliminary ejection may only be performed by the large dot waveform. However, if the preliminary ejection by the large dot waveform is only performed, depending on the head structure or the number of times of the preliminary ejection, even a nozzle containing less trapped air bubbles may have a high possibility of causing nozzle malfunction accidentally. In addition, if the meniscus is extremely destroyed, a nozzle may not be able to recover perfectly even in the next purging operation. Therefore, it is preferable that the preliminary ejection by the small dot waveform is first performed to stabilize the meniscus of ink in a nozzle.

When the preliminary ejection by the large dot waveform is completed, the CPU 50 returns to S1 to S16 to perform the purging operation and the wiping operation again for the nozzles where the maintenance process is directed.

When the second purging and wiping operations are completed, the CPU 50 again determines whether the purging operation is performed a set number of times (S17).

When it determines the operation is performed twice (S20: Yes), the recording head 18 is moved again to the preliminary ejection position (S23), and the preliminary ejection at S24 or later is performed.

At S24, the preliminary ejection with 500 ink droplets by the small dot waveform is set for the purged nozzle. This setting is stored in the RAM 51 shown in FIG. 3. Drive waveform data required to perform the preliminary ejection by the small dot waveform is stored in the ROM 52 shown in FIG. 3. An example of the small dot waveform will be described later.

When the process at S24 is completed, the preliminary ejection with 500 ink droplets by the small dot waveform is performed for the purged nozzle (S25). In this process, based on the data for ejecting 500 ink droplets by the small dot waveform stored in the RAM 51 at S18, the CPU 50 transmits the drive signal from the drive circuit 61 to the recording head 18 via the control circuit 57, and the ink droplets are ejected from the nozzles toward the flushing receiver 7.

This action moistens the nozzles (prevents the nozzles from being dried), and removes the different colored ink, pushed into the nozzles by the wiping operation, and/or the ink including bubbles, and the bubbles and contaminants adhered near the nozzle inside the channel. In addition, this action keeps the meniscus of ink in a nozzle in a stable condition, which will be achieved before ink ejection.

When the preliminary ejection of S25 is completed, the CPU 50 executes the process of S26. At S26, for the purged nozzles, the preliminary ejection with 1,000 ink droplets by the large dot waveform, which requires a larger amount of ink as compared with the small dot waveform, is set. This setting is stored in the RAM 51 shown in FIG. 3. Drive waveform data required to perform the preliminary ejection by the large dot waveform is stored in the ROM 52 shown in FIG. 3. An example of the large dot waveform will be described later.

At S26, to perform the preliminary ejection by the large dot waveform for a nozzle where the purging operation is not performed (hereinafter referred to as non-purged nozzle), the preliminary ejection with 500 ink droplets by the large dot waveform is set. This setting is stored in the RAM 51 shown in FIG. 3.

When the process at S26 is finished, the preliminary ejection is performed for the nozzles where ink ejection of 1,000 or 500 droplets by the large dot waveform is set (S27). In this process, based on the data for ejecting 1,000 or 500 ink droplets by the large dot waveform stored in the RAM 51 at S26, the CPU 50 transmits the drive signal by the large dot waveform from the drive signal 61 to the recording head 18 via the control circuit 57, and the ink droplets are ejected from such nozzles toward the flushing receiver 7 as shown in FIG. 7B.

This action eliminates not only bubbles or other ink trapped in each of the non-purged nozzles but also bubbles trapped deeply into the channel of each of the purged nozzles.

Then, the maintenance process is finished and the ink jet printer 1 is set to a standby state.

In the above maintenance process, the method of preliminary ejection is changed between the purged nozzles and the non-purged nozzles. When the purged nozzles undergo the wiping operation just after the purging operation, they are strongly affected by a negative pressure from the ink cartridge, the ink (containing air bubbles or other color ink) pushed into nozzles due to the wiping operation tends to be drawn deeply into the channels, therefore, strong preliminary ejection is required to eliminate ink containing air bubbles or color-blended ink from the purged nozzles. As to the non-purged nozzles, through the wiping operation, the air bubbles or color-blended ink are less prone to be drawn deeply into the channels because ink is drawn in onto the stable meniscus. Accordingly, comparatively light preliminary ejection is enough to eliminate bubbles or blended ink from the non-purged nozzles.

The non-purged nozzles may also undergo the same preliminary ejection as the purged nozzles. Considering the amount of ink consumed in the preliminary ejection, the maintenance process described above where the preliminary ejection is different according to whether it is the purged nozzle or the non-purged nozzle, is preferable because it consumes less ink.

Figure 6:
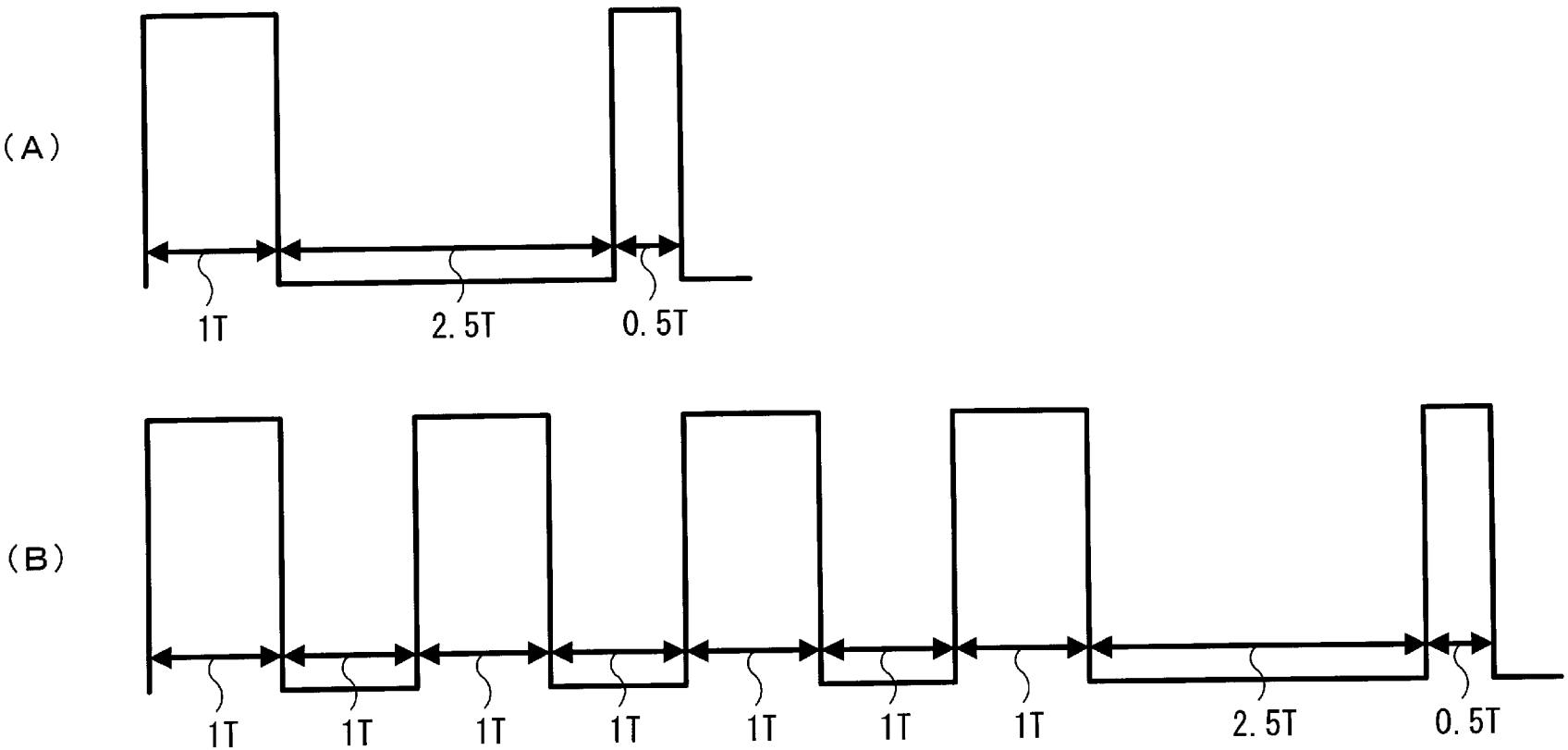
FIG. 6A is a drive waveform for ink ejection used in the ink jet printer.
FIG. 6B is a drive waveform for ink ejection used in the ink jet printer.
Figure 7:
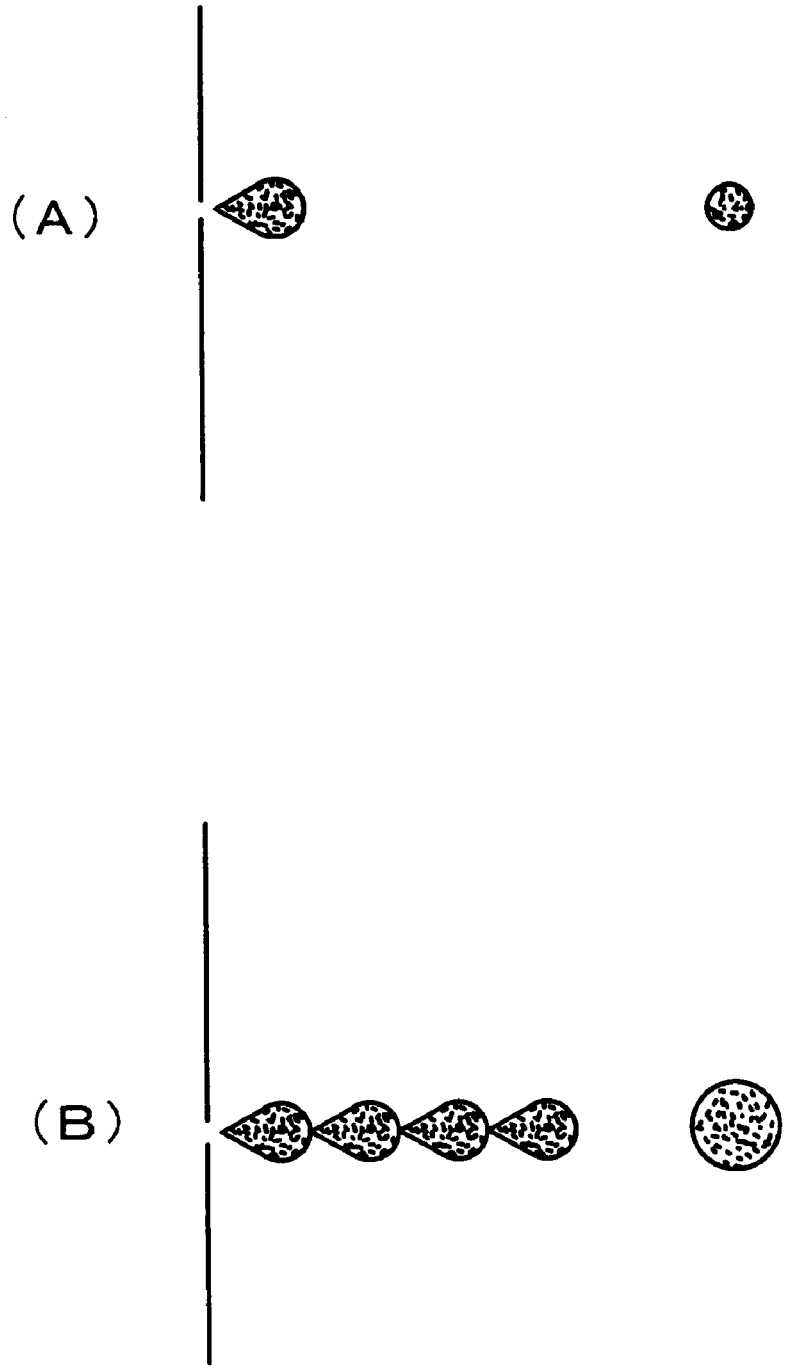
FIG. 7A illustrates a small dot ink ejection.
FIG. 7B illustrates a large dot ink ejection.

The small dot waveform and the large dot waveform will now be described with reference to FIGS. 6, 7. The small dot waveform is an example of a stable waveform where the fluctuations in the pressure applied to the ink in the recording head 18 are low. The large dot waveform is an example of an unstable waveform where the fluctuations in the pressure applied to the ink in the recording head 18 are high. FIG. 6A shows a drive waveform for the small dot waveform that drives the recording head 18, and FIG. 6B shows a drive waveform for the large dot waveform that drives the recording head 18. FIG. 7A is a schematic diagram showing the ink ejection by a small dot, and FIG. 7B is a schematic diagram showing the ink ejection by a large dot.

In this embodiment, the recording head 18 ejects ink droplets to perform gray-scale recording. The waveforms shown in FIGS. 6A, 6B are the same as the drive waveform used for actual printing by the recording head 18. FIG. 6A is a drive waveform when the smallest ink droplets are ejected and FIG. 6B is a waveform when the largest ink droplets are ejected.

A period of time T required for one-way propagation of a pressure wave along the ink channel, is given by an expression $T=L/a$, where "L" is a length of the ink channel in each nozzle for four colors of cyan, magenta, yellow and black of the recording head 18 and "a" is a velocity of speed in the ink in the ink channel. Using the time T, the small dot waveform and the large dot waveform will be described. For example, the time T is 8 $\mu$sec.

As shown in FIG. 6A, in the small dot waveform, when a pulse rises, it turns on at approx. 20 V, continues on for time 1 T, then falls and turns off. When the pulse falls, as shown in FIG. 7A, only one droplet of ink is jetted from the nozzle. After time 2.5 T has expired since the pulse falls, a pulse turns on at approximately 20 V, and falls and turns off after time 0.5 T. The pulse, continuing for time 0.5 T, is intended to balance the fluctuations in pressure remaining in the channel. In the small dot waveform, as only one droplet of ink is ejected, as mentioned above, in one cycle of the print clock ICK, in other words, for one dot, the fluctuations in the pressure in the channel are small. No ink ejection failure occurs even if the ink is continuously ejected for a long time. Therefore, the small dot waveform is a stable waveform.

The large dot waveform will be described. As shown in FIG. 6B, in the large dot waveform, a pulse turns on at approximately 20 V, and falls and turns off after time 1 T has elapsed. When the pulse falls, only one droplet of ink is ejected from the nozzle as shown in FIG. 7B. After the time 1 T has expired since the pulse falls, a pulse turns on at approximately 20 V, and falls and turns off after time 1 T.

When the pulse falls, a second droplet of ink is jetted from the nozzle as shown in FIG. 7B. After the time 1 T has expired since the pulse falls, a pulse turns on at approximately 20 V, and falls and turns off after time 1 T. When the pulse falls, a third droplet of ink is jetted from the nozzle as shown in FIG. 7B.

After the time 1 T has expired since the pulse falls, a pulse turns on at approximately 20 V, and falls and turns off after time 1 T. When the pulse falls, a forth droplet of ink is jetted from the nozzle as shown in FIG. 7B. After the time 2.5 T has expired since the last pulse falls, a pulse turns at approximately 20 V, and falls and turns off after time 0.5 T. The pulse continuing for time 0.5 T is intended to balance the fluctuations in the pressure remaining in the channel.

In the large dot waveform, the above waveform is outputted within one cycle of the print clock ICK, and four droplets of ink are ejected to produce one dot. Therefore, as shown in FIG. 7B, a larger dot is formed at a place where the droplets fall, as compared with the small dot waveform. The large dot waveform is an unstable waveform, which causes great fluctuations in the pressure in the channel. Specifically, when a plurality of pulses are continuously outputted to produce one dot, the fluctuations in pressure remaining in the ink are amplified gradually, causing the ink flow to be changed tremendously in the channels or manifold. If this action continues to produce many dots (e.g. more than 10,000 dots or dots equivalent to at least one line the printer records), the meniscus in each nozzle is greatly depressed, and air is drawn into the ink, so that no ink may be ejected. The large dot waveform of this embodiment is an unstable waveform because such ejection failure is likely to occur.

In the ink jet printer 1 of this embodiment, as the wipe operation is performed for all nozzles after the purging operation, there is a possibility that ink includes minute air bubbles or different color ink. Therefore, the preliminary ejection is performed for all nozzles of the recording head 18 by use of the small dot waveform, which is stable, so that ink including air bubbles or other color ink is eliminated (S20). Accordingly, color mixture of ink in the nozzles of the recording head 18 can be prevented. In addition, bubbles of comparatively large size that can not be expelled during the purging operation can be eliminated.

By the ink ejection using the small dot waveform, the ink in the channels in the recording head 18 is stabilized, so that the meniscus in each nozzle is stabilized. At the preliminary ejection (S22) using the large dot waveform, which is an unstable waveform, a large variation in ink flow is achieved in the channels or manifold. This causes the minute bubbles or contaminants adhered to each wall surface to be moved, minute bubbles to be united to form larger bubbles, or the meniscus of ink in each nozzle to be greatly retracted (destroyed), thereby generating bubbles in the ink to combine them with the existing minute bubbles. At the next purging operation, as the ink where bubbles are generated is eliminated by suction, the minute bubbles and contaminants adhered to each wall surface of the channels or manifold are also eliminated, thereby ensuring the recovery of the recording head 18. In other words, when recording is performed using the large dot waveform, the ink flow generated by the preliminary ejection using the large dot waveform facilitates eliminating objects such as minute bubbles that cause no ink ejection, ensuring that the objects are completely eliminated at the next purging operation.

In the ink jet printer 1 of the embodiment, when the purging operation is done a set number of times, the preliminary ejection using the small dot waveform, which causes small fluctuations in the pressure in the channels, is performed for the purge nozzles (S25). As the ink, including bubbles adhered to the nozzle surface 23, is drawn inside the channels by a back pressure in the purging operation, the ink including bubbles comparatively near the nozzle surface or large bubbles is expelled from the nozzles.

The preliminary ejection using the large dot waveform, which causes great fluctuations in the pressure in the channels, is carried out for all nozzles (S27), and the ink pushed into each nozzle during the wiping operation is expelled. That is, the ink is ejected only with the amount required for prevention of the color mixture of ink, and the bubbles remaining in the channels or manifold or on the interior walls are expelled through the large ink flow. At this time, the preliminary ejection by the large dot waveform is not continued to such an extent that the meniscus in each nozzle is depressed to prevent ink ejection.

These preliminary ejections help to stabilize the meniscus in each nozzle, providing for an immediate recording operation.

In the above embodiment, the small dot waveform and large dot waveform use the same drive waveforms as those used for actual printing. However, they may use individual drive waveforms only for the preliminary ejection.

Further, the small dot waveform and large dot waveform used in the preliminary ejection (S18–S22) performed during intervals between the purging operations may be different from those used in the preliminary ejection (S23–S27) performed after a series of the purging operations are finished.

In the above embodiment, the small dot waveform and the large dot waveform are regarded as the drive waveforms used for the preliminary ejection. The small dot waveform and the large dot waveform may be replaced with a stable waveform causing small fluctuations of the ink pressure in the recording head 18 and an unstable waveform causing larger fluctuations of the ink pressure in the recording head 18, respectively. Even when such stable and unstable waveforms are practiced, the same results can be achieved.

As an example of such stable waveform causing small fluctuations of the ink pressure in the recording head 18, except for the above-described small dot waveform, it is supposed that a waveform for outputting a small dot is output at a low frequency (approx. 1 kHz). As an example of such an unstable waveform causing great fluctuations of ink pressure in the recording head 18, except for the above-described large dot waveform, it is supposed that a waveform for outputting a small dot is output at higher frequency than approx. 1 kHz. As a stable waveform, a large dot waveform can be outputted continuously. As an unstable waveform, a large dot waveform can be intermittently outputted. However, the stable waveform and the unstable waveform are varied depending on the characteristics or size of the recording head.

While the invention has been described in connection with a specific embodiment thereof, it should be understood that the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art. For example, except for the ink jet printer, the invention can be applied to various recording apparatuses such as a facsimile machine.

In the above embodiment, the preliminary ejection is performed each time during intervals between the purging operations, however, it may be performed before at least one of a series of purging operations.

Figure 8:
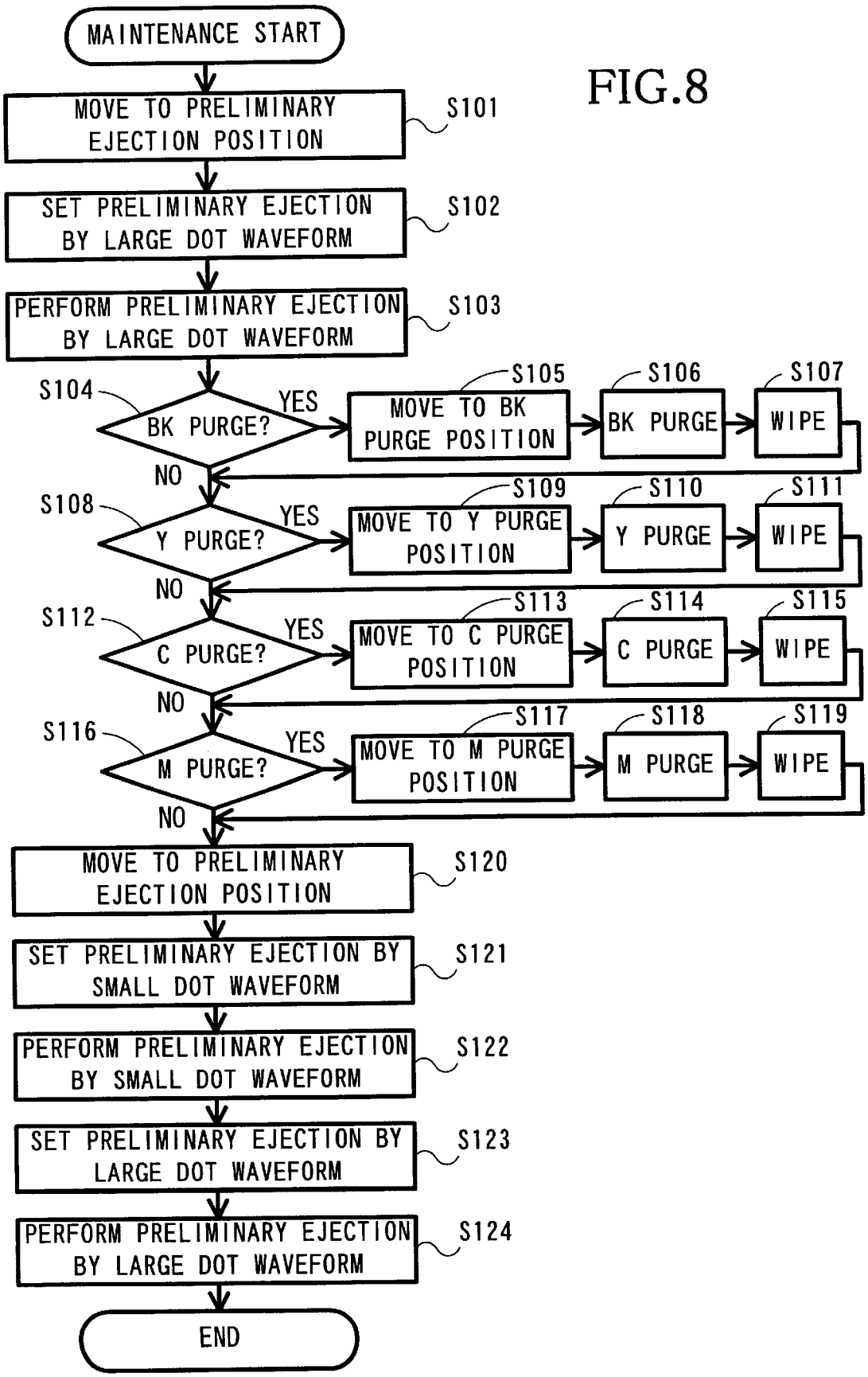
FIG. 8 is a flowchart illustrating a maintenance process of the ink jet printer in another embodiment of the invention.

Further, even if a one-time-only purging operation is performed, before the purging operation, the preliminary ejection using the large dot waveform or the unstable waveform may be performed for a group of nozzles planned to undergo the purging operation as shown in FIG. 8.

In the above embodiment, the wiping operation is performed for all nozzles every time. However, the invention can be applied to an ink jet printer structured so that the wiping operation can be performed separately for each group of nozzles allocated to individual colors. In this case, as the wiping operation is done separately for each group of nozzles, the possibility of mixture of color inks is reduced. However, the wiping operation still has a possibility that ink including bubbles is forced into the nozzles. Further, when the wiping operation is performed for each group of nozzles using the same wiper, the ink adhered to the wiper during the previous wiping operation may enter the next group of nozzles where other color ink is used at the next wiping operation.

What is claimed is:

1. An ink jet recording apparatus, comprising:

a head unit having a recording head that performs recording by ejecting ink onto a recording medium;

a wiper mechanism that wipes the ink adhered to a nozzle surface of the recording head; and a preliminary ejection device that applies a drive voltage waveform for preliminary ejection to the recording head, the preliminary ejection device comprising:

a first preliminary ejection drive device that generates a stable waveform which causes small fluctuations of ink pressure in the recording head, and applies the stable waveform to the recording head to cause a first preliminary ejection;

a second preliminary ejection drive device that generates an unstable waveform which causes larger fluctuations of ink pressure per one cycle of a print clock in the recording head than the first preliminary ejection, and applies the unstable waveform to the recording head to cause a second preliminary ejection; and a control device that actuates the first preliminary ejection drive device after a wiping operation by the wiper mechanism so that the recording head performs the first preliminary ejection, and then actuates the second preliminary ejection drive device so that the recording head performs the second preliminary ejection.

2. The ink jet recording apparatus according to claim 1, further comprising a purge mechanism that forces the recording head to purge the ink therefrom by sucking the ink from an ink ejection side of the recording head or by applying a pressure to an ink supply side of the recording head, to improve an ink ejection condition, wherein the control device actuates both the first and second preliminary ejection drive devices only after the wiping operation executed by the wiper mechanism, which is executed after a purging operation by the purge mechanism, so that the recording head performs both of the preliminary ejection by the stable and unstable waveforms respectively.

3. The ink jet recording apparatus according to claim 1, wherein the unstable waveform has more ejection pulses for producing one dot than the stable waveform.

4. The ink jet recording apparatus according to claim 2, wherein the head unit has a plurality of groups of nozzles and the purge mechanism is capable of performing the purging operation selectively for the groups of nozzles, and after the wiping operation executed by the wiper mechanism which is executed after the purging operation by the purge mechanism, as to the selected at least one group of nozzles where the purging operation has been done, the control device actuates the first preliminary ejection drive device to cause the first preliminary ejection, then actuates the second preliminary ejection drive device to cause the second preliminary ejection, and as to the rest of the groups of nozzles where the purging operation has not been done, the control device actuates the second preliminary ejection drive device to only perform the second preliminary ejection.

5. The ink jet recording apparatus according to claim 4, wherein the control device controls an amount of ejected ink at a preliminary ejection so that a total amount of the ejected ink per nozzle of the selected at least one group of nozzles at the second preliminary ejection is greater than a total amount of the ejected ink per nozzle of the rest of the groups of nozzles at the second preliminary ejection.

6. The ink jet recording apparatus according to claim 1, wherein the stable waveform includes a pulse to balance the fluctuations in pressure remaining in the recording head.

7. The ink jet recording apparatus according to claim 1, wherein the unstable waveform has a higher drive frequency than the stable waveform.

8. An ink jet recording apparatus, comprising:

a head unit having a recording head that performs recording by ejecting ink onto a recording medium;

a wiper mechanism that wipes the ink adhered to a nozzle surface of the recording head; and a preliminary ejection device that applies a drive voltage waveform for a preliminary ejection to the recording head, the preliminary ejection device comprising:

a first preliminary ejection drive device that generates a first drive voltage waveform, which causes a small amount of ink to be ejected, and applies the first drive voltage waveform to the recording head to perform a first preliminary ejection by small droplets;

a second preliminary ejection drive device that generates a second drive voltage waveform, which causes a larger amount of ink to be ejected than the amount of ink at the first preliminary ejection by the small droplets, and applies the second drive voltage waveform to the recording head to perform a second preliminary ejection by larger droplets than the first preliminary ejection; and a control device that actuates the first preliminary ejection drive device after a wiping operation by the wiper mechanism so that the recording head performs the first preliminary ejection, and then actuates the second preliminary ejection drive device so that the recording head performs the second preliminary ejection.

9. The ink jet recording apparatus according to claim 8, further comprising a purge mechanism that forces the recording head to purge the ink therefrom by sucking the ink from an ink ejection side of the recording head or by applying a pressure to an ink supply side of the recording head, to improve an ink ejection condition, and wherein the control device actuates both the first and second preliminary ejection drive devices only after the wiping operation executed by the wiper mechanism, which is executed after a purging operation by the purge mechanism, so that the recording head performs both of the preliminary ejection by small droplets and large droplets respectively.

10. The ink jet recording apparatus according to claim 8, wherein the second drive voltage waveform has more ejection pulses for producing one dot than the first drive voltage waveform.

11. The ink jet recording apparatus according to claim 9, wherein the head unit has a plurality of groups of nozzles and the purge mechanism is capable of performing the purging operation selectively for the groups of nozzles, and after the wiping operation executed by the wiper mechanism which is executed after the purging operation by the purge mechanism, as to the selected at least one group of nozzles where the purging operation has been done, the control device actuates the first preliminary ejection drive device to perform the first preliminary ejection, then actuates the second preliminary ejection drive device to perform the second preliminary ejection, and as to the rest of the groups of nozzles where the purging operation has not been done, the control device actuates the second preliminary ejection drive device to perform the second preliminary ejection only.

12. The ink jet recording apparatus according to claim 11, wherein the control device controls an amount of ejected ink at the preliminary ejection so that a total amount of ejected ink per nozzle of the selected at least one group of nozzles at the second preliminary ejection is greater than a total amount of ejected ink per nozzle of the rest of the group of nozzles at the second preliminary ejection.

13. An ink jet recording apparatus, comprising:

a head unit having a recording head that performs recording by ejecting ink onto a recording medium;

a purge mechanism that forces the recording head to purge the ink therefrom by sucking the ink from an ink ejection side of the recording head or by applying a pressure to an ink supply side of the recording head, to improve an ink ejection condition; and a preliminary ejection device that generates a drive voltage waveform, including at least one stable waveform and at least one unstable waveform, which causes larger fluctuations of ink pressure per one cycle of a print clock in the recording head than the stable waveform, and applies the drive voltage waveform for a preliminary ejection of ink drops from the recording head to a receiver, wherein the preliminary ejection device comprises a control device that causes the recording head that undergoes a purging operation to perform the preliminary ejection caused by applying the unstable waveform continuously, which causes residual fluctuations of ink pressure in the recording head to be amplified gradually through the preliminary ejection, before the purging operation by the purge mechanism.

14. The ink jet recording apparatus according to claim 13, wherein before the purging operation, the control device first generates a stable waveform and performs a first preliminary ejection through the application of the stable waveform to the recording head, and then the control device generates the unstable waveform and performs a second preliminary ejection by the unstable waveform.

15. The ink jet recording apparatus according to claim 14, wherein the unstable waveform has more pulses for producing one dot than the stable waveform.

16. The ink jet recording apparatus according to claim 13, wherein when the purge mechanism successively performs a series of purging operations, the control device causes the recording head to perform the preliminary ejection by the unstable waveform at least once before at least one of the purging operations.

17. A maintenance method for returning the ink ejection to a proper status in an ink jet recording apparatus including a head unit having a recording head that performs recording by ejecting ink onto a recording medium, the method comprising the steps of:

wiping ink adhered to a nozzle surface of the recording head by a wiper mechanism;

performing a first preliminary ejection after the step of wiping by the wiper mechanism through the generation of a stable waveform as a first drive voltage waveform which causes small fluctuations of ink pressure in the recording head and the application of the stable waveform to the recording head; and performing a second preliminary ejection after the step of performing the first preliminary ejection through the generation of an unstable waveform as a second drive voltage waveform, which causes larger fluctuations of ink pressure per one cycle of a print clock in the recording head than the first preliminary ejection, and the application of the unstable waveform to the recording head.

18. The maintenance method according to claim 17, further comprising a step of purging in which the recording head is forced to purge the ink therefrom by sucking the ink from an ink ejection side of the recording head or by applying a pressure to an ink supply side of the recording head, to improve an ink ejection condition, and wherein after the purging step, the recording head undergoes the step of wiping, the step of performing the first preliminary ejection, and the step of performing the second preliminary ejection.

19. The maintenance method according to claim 17, wherein the unstable waveform applied in the step of performing the second preliminary ejection has more ejection pulses for producing one dot than the stable waveform applied in the step of performing the first preliminary ejection.

20. The maintenance method according to claim 17, wherein the stable waveform applied in the step of performing the first preliminary ejection includes a pulse to balance the fluctuations in pressure remaining in the recording head.

21. A maintenance method for returning the ink ejection to a proper status in an ink jet recording apparatus including a head unit having a plurality of groups of nozzles that perform recording by ejecting ink onto a recording medium, the method comprising the steps of:

purging selectively the groups of nozzles;

wiping the ink adhered to a nozzle surface by a wiper mechanism alter the purging step;

performing a first preliminary ejection after the step of wiping by the wiper mechanism through the generation of a stable waveform as a first drive voltage waveform which causes small fluctuations of ink pressure in the nozzle and the application of the stable waveform to the selected at least one group of nozzles which the purging step has been done; and performing a second preliminary ejection alter the step of performing the first preliminary ejection through the generation of an unstable waveform as a second drive voltage waveform, which causes larger fluctuations of ink pressure per one cycle of a print clock in the nozzle than the first preliminary ejection, and the application of the unstable waveform to all groups of nozzles.

22. The maintenance method according to claim 21, wherein in the step of performing the second preliminary ejection, a total amount of ejected ink at the second preliminary ejection per nozzle of the selected at least one group of nozzles where the purging operation has been done is greater than a total amount of ejected ink at the second preliminary ejection per nozzle of the rest of groups of nozzles where the purging operation has not been done.

23. A maintenance method for returning the ink ejection to a proper status in an ink jet recording apparatus including a head unit having a recording head that performs recording by ejecting ink onto a recording medium, the method comprising the steps of:

wiping the ink adhered to a nozzle surface of the recording head by a wiper mechanism;

performing a first preliminary ejection after the step of wiping by the wiper mechanism by small droplets through the generation of a first drive voltage waveform which causes a small amount of ink to be ejected and the application of the first drive voltage waveform to the recording head; and performing a second preliminary ejection after the step of performing the first preliminary ejection by larger droplets than the first preliminary ejection through the generation of a second drive voltage waveform which causes a larger amount of ink to be ejected than the amount of ink at the first preliminary ejection by the small droplets, and the application of the second drive voltage waveform to the recording head.

24. The maintenance method according to claim 23, further comprising a step of purging in which the recording head is to purge the ink therefrom by sucking the ink from an ink ejection side of the recording head or by applying a pressure to an ink supply side of the recording head, to improve an ink ejection condition, wherein after the purging step, the recording head undergoes the step of wiping, the step of performing the first preliminary ejection, and the step of performing the second preliminary ejection.

25. The maintenance method according to claim 23, wherein the drive voltage waveform applied in the step of performing the second preliminary ejection has more ejection pulses for producing one dot than the drive voltage waveform applied in the step of performing the first preliminary ejection.

26. A maintenance method for returning the ink ejection to a proper status in an ink jet recording apparatus including a head unit having a plurality of groups of nozzles that perform recording by ejecting ink onto a recording medium, the method comprising the steps of:

purging selectively the groups of nozzles;

wiping the ink adhered to a nozzle surface by a wiper mechanism after the purging step;

performing a first preliminary ejection after the step of wiping by the wiper mechanism by small droplets through the generation of a first drive voltage waveform which causes a small amount of ink to be ejected and the application of the first drive voltage waveform only to the selected at least one group of nozzles which the purging step has been done; and performing a second preliminary ejection after the step of performing the first preliminary ejection by larger droplets than the first preliminary ejection through the generation of a second drive voltage waveform which causes a larger amount of ink to be ejected than the amount of ink at the first preliminary ejection by the small droplets, and the application of the second drive voltage waveform to all groups of nozzles.

27. The maintenance method according to claim 26, wherein in the step of performing the second preliminary ejection, a total amount of ejected ink at the second preliminary ejection per nozzle of the selected at least one group of nozzles is greater than a total amount of ejected ink at the second preliminary ejection per nozzle of the rest of the groups of nozzles.

28. A maintenance method for returning the ink ejection to a proper status in an ink jet recording apparatus comprising a head unit having a recording head that performs recording by ejecting ink onto a recording medium, the method comprising the steps of:

performing a preliminary ejection of ink drops from the recording head to a receiver, through the generation of an unstable waveform as a drive voltage waveform and a continuous application of the unstable waveforms to the recording head, which causes residual fluctuations of ink pressure in the recording head to be amplified gradually through the preliminary ejection; and purging the recording head of the head unit after the step of performing the preliminary ejection.

29. The maintenance method according to claim 28, wherein a series of purging steps are successively performed, and the step of the preliminary ejection is performed at least once before at least one of the purging steps.

30. A maintenance method for returning the ink ejection to a proper status in an ink jet recording apparatus comprising a head unit having a recording head that performs recording by ejecting ink onto a recording medium, the method comprising the steps of:

purging the recording head of the head unit;

wiping the ink adhered to a nozzle surface of the recording head after the purging step;

performing a first preliminary ejection after the wiping step through the generation of a stable waveform as a first drive voltage waveform which causes small fluctuations of ink pressure in the recording head and the application of the stable waveform to the recording head;

performing a second preliminary ejection after the step of performing the first preliminary ejection through the generation of an unstable waveform as a second drive voltage waveform which causes larger fluctuations of ink pressure per one cycle of a print clock in the recording head than the first preliminary ejection, and the application of the unstable waveform to the recording head; and purging the recording head again.

* * * * *